US005221404A

United States Patent [19]

Oya et al.

[11] Patent Number: 5,221,404

[45] Date of Patent: Jun. 22, 1993

[54] AUTOMATIC TAPE CASSETTE VENDING MACHINE

[75] Inventors: Kinichiro Oya, Kawasaki; Sadao Iwaya, Funabashi, both of Japan

[73] Assignee: TDK Corporation, Tokyo, Japan

[21] Appl. No.: 613,742

[22] PCT Filed: Mar. 23, 1990

[86] PCT No.: PCT/JP90/00390

§ 371 Date: Nov. 20, 1990

§ 102(e) Date: Nov. 20, 1990

[87] PCT Pub. No.: WO90/11584

PCT Pub. Date: Apr. 10, 1990

[30] Foreign Application Priority Data

Mar. 24, 1989 [JP] Japan ..... 1-70574

[51] Int. Cl.[5] ..... B65H 19/20

[52] U.S. Cl. ..... 156/350; 156/502; 156/505; 156/506; 156/510; 242/56 R; 242/58.4

[58] Field of Search ..... 156/502, 505, 506, 350, 156/510; 242/56 R, 58.4

[56] References Cited

U.S. PATENT DOCUMENTS 3,997,123 12/1976 King ..... 156/502
4,062,719 12/1977 Masuzima et al. ..... 156/502
4,609,422 9/1986 Becking ..... 156/502
4,632,327 12/1986 Kreeft et al. ..... 156/502
4,654,479 3/1987 Ogaki et al. ..... 360/15
4,738,408 4/1988 Odaka et al. ..... 242/56

FOREIGN PATENT DOCUMENTS 60-245097 12/1985 Japan ..... 360/15
62-6400 1/1987 Japan ..... 360/15
62-202384 9/1987 Japan ..... 156/502
62-257689 11/1987 Japan ..... 360/15

OTHER PUBLICATIONS

Japanese Patent Application Laid Open Publication No. 6400/1987 (62-6400).

*Primary Examiner*—David A. Simmons
*Assistant Examiner*—J. Sells
*Attorney, Agent, or Firm*—Price, Gess & Ubell

[57] ABSTRACT

An automatic tape cassette vending machine capable of automatically selecting a desired kind of a magnetic tape and a cassette casing and automatically determining a desired length of the magnetic tape, to thereby meet desired requirements of user's, when they input desired conditions such as a type of a magnetic tape, the length of a magnetic tape, a type of a cassette casing and the like.

5 Claims, 7 Drawing Sheets 160
162A
162B
162C
P
P
P
156
164
158
154
166

160
24A
24B
24C
156
158
154
166

23
156
154

166
156
23R
154
23L 156
23R
24A
24B
24C
154
23L
166

156
24B
168
154
23L 156
24B
154
166

166
156
24B
154
24B 156
23R
24A
24B
24C
154
24B
166

170
156
23R
154
24B

AUTOMATIC TAPE CASSETTE VENDING MACHINE

TECHNICAL FIELD

This invention relates to an automatic tape cassette vending machine which is adapted to automatically vend an audio or video tape cassette in which a magnetic tape is housed.

BACKGROUND ART

In general, a magnetic tape for audio use, video use or the like is on sale in a manner to be housed in a cassette casing while being wound on a pair of reel hubs. Manufacturers each prepare various kinds of tape cassettes in which magnetic tapes of lengths predetermined according to various standard specifications for each grade are wound on the reel hubs. For example, audio tape cassettes in which various magnetic tapes of lengths corresponding to the amounts of recording time such as a forty-six-minute tape, a sixty-minute tape and a ninety-minute tape, as well as a fifty-four-minute tape, an eighty-minute tape and the like are housed are standardized and commercially available for each grade. Users selectively buy such audio tape cassettes as intended.

Unfortunately, the users are merely permitted to purchase only tape cassettes including magnetic tapes of lengths defined in the standard specifications, resulting in being forced to purchase a tape cassette in which a somewhat long tape is housed although they know well that at least a part of the tape will be in vain. In particular, in view of the present situation that sources of data to be recorded are substantially diversified, it would be highly difficult or substantially impossible to provide a tape cassette which meets user's requirements and minimizes the portion of a magnetic tape which is out of use. For example, when the time length of a recorded source is slightly larger, for example, in an amount less than one minute, than that of a magnetic tape defined by the standard specifications, an additional tape is required to record the excessive portion of the recorded source. This results in a large part of the additional tape being out of use. Also, this causes latency time to be substantially increased when the tape is to be played back. Further, this causes a user to feel displeasure during the playing-back, because the additional tape substantially exhibits a soundless condition wherein only noise is generated therefrom. It would be considered that such a disadvantage is eliminated by providing a tape cassette including a magnetic tape having a length corresponding to a short period of recording time such as, for example, a one-minute magnetic tape. However, such an approach causes not only the manufacturing and distributing costs to be highly increased, resulting in being uneconomical, but excessive kinds of tape cassettes to be placed on the market to render both selection of tape cassettes by the user and handling of tape cassettes by suppliers extremely troublesome and time-consuming.

DISCLOSURE OF INVENTION

The present invention is to eliminate the above-described disadvantages of the prior art.

In accordance with the present invention, there is provided an automatic tape cassette vending machine comprising a tape feed reel on which a magnetic tape is wound; a tape feed mechanism for dispensing the magnetic tape from said tape feed reel; a tape length measuring mechanism for measuring the length of the magnetic tape fed by means of said tape feed mechanism; a magazine means for storing therein a plurality of assembled empty cassette casings each for winding up therein the tape of which the length has been measured; a cassette casing feed mechanism for taking out the empty cassette casing from said magazine means; a splicing mechanism for connecting the tape which has passed through said tape length measuring mechanism to the empty cassette casing fed by said cassette casing feed mechanism; a tape take-up mechanism for winding up the tape in the empty cassette casing; a setting section for inputting data on desired conditions; a computer unit for actuating said tape feed mechanism, cassette casing feed mechanism, splicing mechanism and tape take-up mechanism depending upon the data input and a measurement signal supplied from said tape length measuring mechanism; and a charge settling mechanism for detecting cash and/or money equivalents inserted thereinto to actuate said computer unit to cause it to carry out charge settlement based on the input data.

In the automatic tape cassette vending machine of the present invention constructed as described above, when a user inputs desired conditions such as, for example, the length of a magnetic tape required (recording time) and the like through a keyboard of the setting section or the like to the machine, the machine automatically cuts a magnetic tape into a desired length and discharges it while winding it on reels in a cassette casing, so that the user may obtain a tape cassette in which a magnetic tape of a desired length is housed.

In a preferred embodiment of the present invention, said tape feed mechanism comprises a plurality of feed reels having different kinds of magnetic tapes wound up thereon, respectively, and a drive mechanism capable of driving said feed reels separate from each other; said magazine means comprises a plurality of magazines in which different kinds of empty cassette casings are stored, respectively; said cassette casing feed mechanism includes a cassette casing taking-out mechanism for selectively taking out the empty cassette casing from said magazines; and said machine further comprises a tape changing-over mechanism for selecting any desired magnetic tape from the magnetic tapes different in kind and feeding it to said splicing mechanism. Such construction permits any desired magnetic tape to be selected from various kinds of magnetic tapes, cut into a desired length and housed in a cassette casing while being wound on reels, resulting in a user readily obtaining a tape cassette which has a magnetic tape of desired kind and length housed in a cassette casing.

In the automatic tape cassette vending machine of the present invention, when a user is to purchase a tape cassette in which a magnetic tape of desired kind and length is housed, he inserts cash such as a coin or a bill or a money equivalent such as a cash card or the like in the machine, so that the amount of money inserted may be displayed on a monitor employing both an audio response system and a character response system by a CRT. Then, the user inputs any desired conditions such as, for example, the type and length of a magnetic tape desired, a label and/or a casing required, and the like through a keyboard of the setting section or the like, which are then processed in the computer unit, so that not only charge, confirmation of the input conditions, additional amount of money required, change, the balance of a cash card and the like are displayed, but the charge settling operation is carried out. Concurrently, the cassette feed mechanism and tape feed mechanism are actuated to feed a desired magnetic tape and a desired empty cassette casing to the splicing mechanism, wherein the magnetic tape is connected to a leader tape arranged in the empty cassette casing. Then, the magnetic tape is taken up into the cassette casing and then cut into a desired length depending upon the measurement at the tape length measuring mechanism, resulting in a tape cassette which meets the input conditions being discharged through a tape cassette taking-out port. A label, a packaging casing and an index card may be fed from a label feed mechanism, a packaging casing feed mechanism and an index card feed mechanism, respectively, as required. Thus, the automatic tape cassette vending machine of the present invention permits a user to readily purchase a tape cassette of desired kind and recording time.

BRIEF DESCRIPTION OF DRAWINGS

The drawings show an embodiment of an automatic tape cassette vending machine according to the present invention; wherein.

BEST MODES FOR CARRYING OUT INVENTION

Now, the present invention will be described hereinafter in connection with an embodiment thereof shown in the accompanying drawings.

Figure 2:
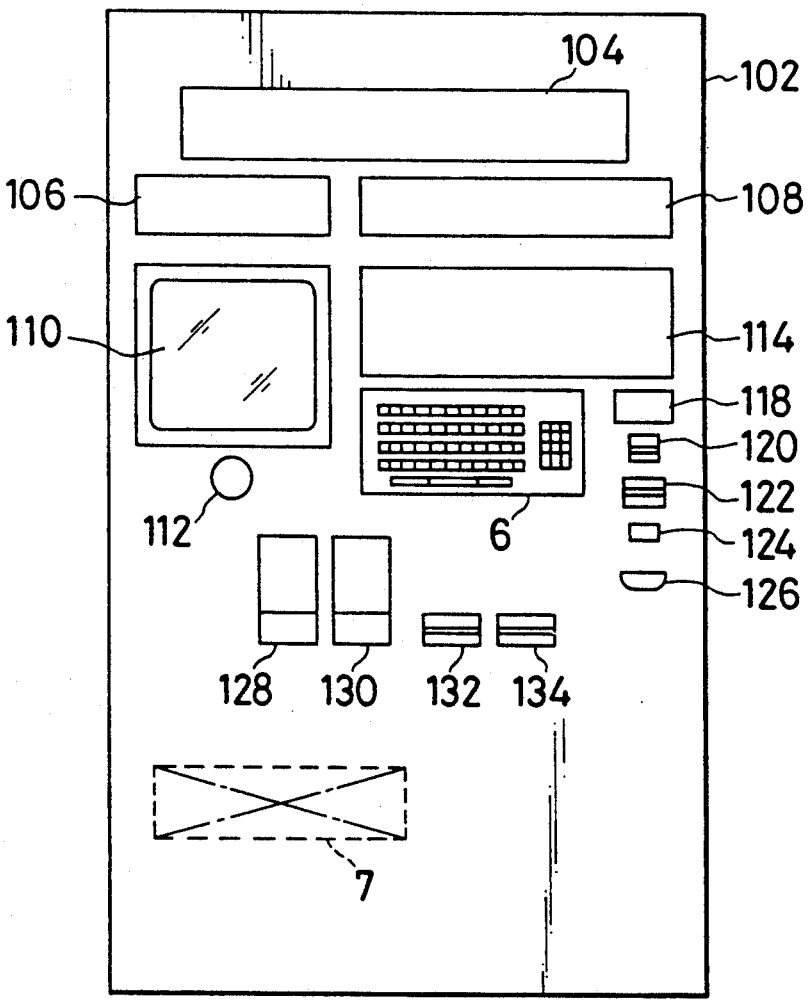
FIG. 2 is a front elevation view generally showing an automatic tape cassette vending machine according to the present invention.

FIG. 2 is a front elevation view generally showing an automatic tape cassette vending machine which is assembled into a single cabinet. A cabinet 102 has a mechanical apparatus and an electric apparatus housed therein, which will be described hereinafter. The cabinet 102 is provided on the front surface thereof with a sample showcase 104 in which trade samples are shown, a shortage indicator panel 106, a notice board 108, a cathode ray tube (CRT) 110 acting as a monitor and a speaker 112, a specification indicator panel 114 for directing the preparation of specifications, a setting section 6 provided with a key board for inputting desired specification conditions, a display section 118 for indicating the amount of money charged in the machine, a card inserting section 120, a bill inserting section 122, a coin slot or inlet port 124, a change returning section 126, a cassette tape taking-out port 128 for taking out a tape cassette which is a commodity vended by the machine therethrough from the machine, a casing taking-out port 130 for taking out a packaging casing for the tape cassette therethrough from the machine, a label taking-out port 132 for taking out a label to be attached to the casing therethrough from the machine, and an index card taking-out port 134 for taking out an index card therethrough from the machine. Reference numeral 7 designates a computer unit. The operation will be described hereinafter.

Now, the main part of an automatic tape cassette vending machine adapted to deliver any desired combination of different kinds of magnetic tapes and cassettes stored therein which is an embodiment of the present invention will be described hereinafter with reference to FIGS. 1 to 4. The automatic tape cassette vending machine of the illustrated embodiment includes a tape magazine 1 which holds therein a plurality of tape feed reels 101 having various grades or different kinds of magnetic tapes such as, for example, an IEC magnetic tape, a Type-I magnetic tape, a Type-II magnetic tape and the like wound thereon, respectively, and a motor (not shown) acting as a tape drive mechanism for driving the tape magazine 1. The tape feed reels 101 are driven separate from each other through a conventional mechanism such as a clutch means using a motor means. Also, the automatic tape cassette vending machine includes a tape changing-over mechanism 2 for automatically selecting a desired magnetic tape from different kinds of magnetic tapes 24 wound on the tape feed reels 101 and then feeding it to a length measuring mechanism for measuring the length of the magnetic tape. The tape changing-over mechanism 2 may comprise a slider or a suction mechanism which is adapted to hold one end of each of the magnetic tapes on a feed roller and travel for carrying out changing-over of the magnetic tapes.

Figure 5A:
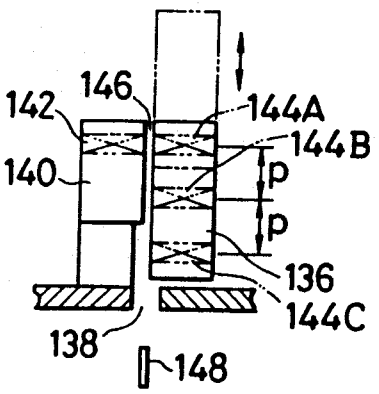
FIG. 5A is a partially sectional schematic view showing a tape changing-over mechanism.

Also, for a changing-over section of the tape changing-over mechanism 2 may be used a multiple slider 136 as shown in FIG. 5A. More particularly, in the illustrated embodiment, three feed reels on which three kinds of magnetic tapes 24A, 24B and 24C are respectively wound are arranged in the tape magazine 1 shown in FIG. 1 while being vertically superposed together. Also, on the side of the tape feed reels 101 based on a parting line 138, sagging mechanisms 40 for placing the tapes under appropriate tension conditions, guide rollers and the like are disposed vertically in three stages corresponding to the tapes 24A, 24B and 24C, respectively. On the side of s splicing mechanism 52 based on the parting line 138 are arranged the tape length measuring mechanism 51 and the like in a single stage.

As shown in FIG. 5A, a holding member 140 is fixedly provided on the side of the splicing mechanism 52 based on the parting line 138 or on the left side in FIG. 5A. The holding member 140 is provided at a part thereof with a suction section 142 for holding the magnetic tape thereon by vacuum suction. The multiple slider 136 is arranged on the side of the tape feed reels 101 or on the right side in FIG. 5A based on the parting line 138 and provided with suction sections 144A, 144B and 144C for holding the magnetic tapes 24A, 24B and 24C thereon by vacuum suction in a manner to be vertically movable. The multiple slider 136 is spaced from the holding member 140 through a gap 146 defined therebetween. The multiple slider 136 is moved by a pitch P at a time in a direction perpendicular to the direction of traveling of the magnetic tape by means of an intermittent lifting mechanism which may comprise a conventional stepping mechanism utilizing a cylinder, a rack, a screw, a solenoid and the like, so that the suction sections 144A, 144*b* and 144*c* may be caused to be opposite to the suction section 142. Reference numeral 148 designates a cutter adapted to be vertically moved through the gap 146 to cut the magnetic tape.

Figure 5B:
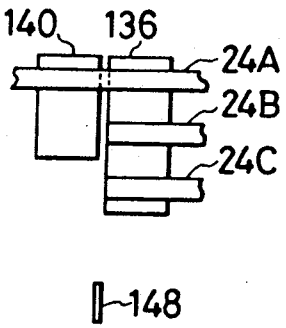
FIGS. 5B to 5I each are a schematic view showing the operation of the tape changing-over mechanism shown in FIG. 5A.
Figure 5C:
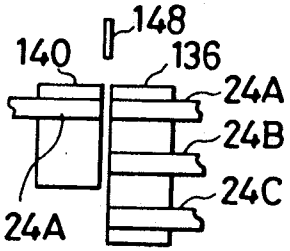
Figure 5D:
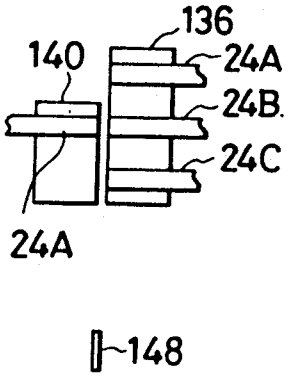

Now, a tape changing-over operation will be described in connection with changing-over from the magnetic tape 24A to the magnetic tape 24B with reference to FIGS. 5B to 5I. FIG. 5B shows a state that the magnetic tape 24A is guided to the splicing mechanism 52 and the length of dispensing of the tape 24A detected by the tape length measuring mechanism coincides with a predetermined value, resulting in the delivery of the magnetic tape 24A being stopped. Then, the cutter 148 is upwardly moved to cut the tape 24A as shown in FIG. 5C. Thereafter, the multiple slider 136 is lifted by one pitch P, so that the tape 24B is positioned opposite to the tape 24A held on the holding section 142 of the holding member 140 as shown in FIG. 5D.

Figure 5E:
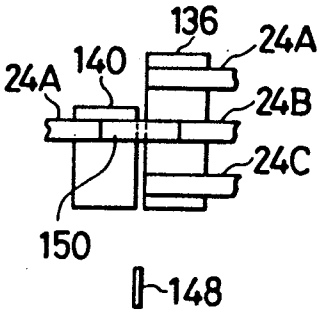
Figure 5F:
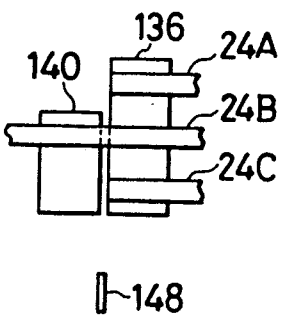

Subsequently, as shown in FIG. 5E, the tape 24A and 24B are connected to each other by means of an adhesive tape 150. Then, when the tape 24A held on the holding member 140 is introduced into a cassette casing 21 together with a leader tape 23 through the splicing mechanism 52 for the winding-up, the tape 24B adhered to the tape 24A is introduced into the cassette casing 21 through the holding member 140 as shown in FIG. 5F, resulting in the changing-over or switching from the tape 24A to the tape 24B being completed.

Figure 5G:
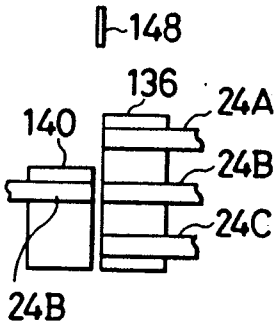
Figure 5H:
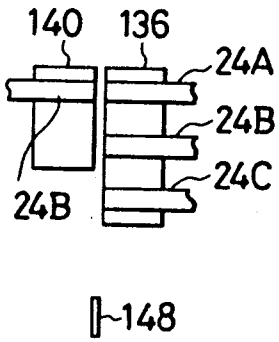
Figure 5I:
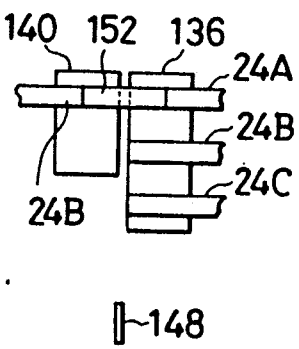

Then, when the dispensing of the tape by the predetermined length is detected by the tape length measuring mechanism 51, the feeding of the tape 24B is stopped and then it is cut by the cutter 148 as shown in FIG. 5G. Thereafter, when the switching from the tape 24B to 24A is desired, the multiple slider 136 is lowered to cause the tape 24A to be opposite to the tape 24B held on the holding member 140 as shown in FIG. 5H and then the tape 24A is connected to the tape 24B by means of an adhesive tape 152 as shown in FIG. 5I.

The illustrated embodiment causes a different tape to be connected to a desired tape subsequent to a leader tape. This is prevented by incorporating the multiple slider in the splicing mechanism 52, which will be described hereinafter.

Reference numerals 3 and $3_1$ each designate a cassette casing magazine in which a plurality of empty cassette casings 21 different in kind depending upon the applications or depending upon, for example, lengths of magnetic tapes are received, and reference numeral 4 designates a cassette casing feed mechanism for taking out a cassette casing from desired one of the cassette casing magazines and deliver it to a cassette casing holder 41.

The tape length measuring mechanism 51 may be constructed in a conventional manner. More particularly, it may be constructed so as to detect or measure the length of traveling of a tape based on the number of rotations of a single roller or a pair of rollers rotating contiguous to the magnetic tape 24. Thus, the tape length measuring mechanism 51 detects the length of dispensing of the magnetic tape and generates a signal when the predetermined length of the tape is detected.

The splicing mechanism 52 is adapted to connect the magnetic tape 24 passing through the tape length measuring mechanism 51 to the leader tape 23 of the cassette casing 21 held on the cassette casing holder 41, and a take-up motor 26 serving as a tape take-up mechanism causes the magnetic tape 24 to be wound up by a predetermined length in the cassette casing 21 depending upon the signal supplied from the tape length measuring mechanism 51.

The splicing mechanism 52 suitable for use in the present invention is disclosed in, for example, Japanese Patent Publication No. 21784/1976 or U.S. Pat. No. 4,062,719.

Figure 6:
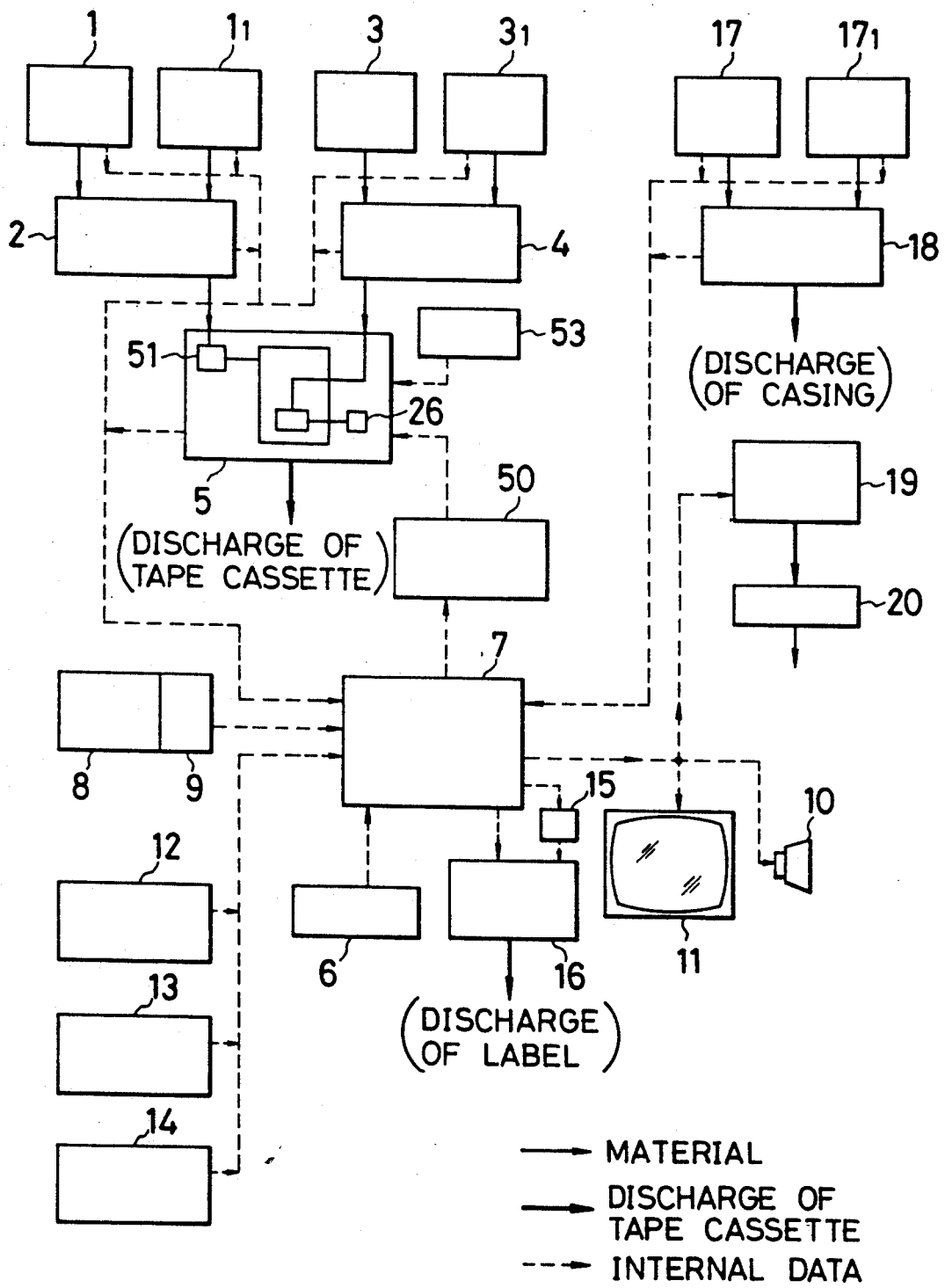
FIG. 6 is a block diagram showing the operation of the automatic tape cassette vending machine shown in FIG. 2.

The components other than the above-described ones provided on the cabinet 102 in which the automatic tape cassette vending machine is wholly housed will be described with reference to FIGS. 2 and 6. The setting section 6 is adapted to input thereto desired conditions such as types and lengths of magnetic tapes, types of cassette casings, types of packaging casings and the like by means of a key board, a dial, or the like. The computer unit 7 is adapted to carry out automatic processing of data on the conditions input to the setting section 6 and connected to the above-described feed and handling mechanism for the magnetic tapes and cassette casings. The computer unit 7 is actuated through a charge settling mechanism 9 including a counter 8 which is adapted to carry out reading of cash such as bills and coins and money equivalents such as cash cards, telephone cards and the like inserted in the machine and display the amount of money.

When a magnetic tape to be handled is of only one kind, a continuous feed mechanism may be substituted for the tape changing-over mechanism. However, when various kinds of magnetic tapes are to be handled or a magnetic tape is to be replenished, the tape changing-over mechanism is conveniently used. In this instance, a plurality of additional magnetic tape supply lines may be added as required.

The computer unit 7 includes a data processing section for processing the data on the desired conditions input in the form of an analog signal or a digital signal thereto to covert the data to a digital signal or an analog signal by means of an A/D converter, a D/A converter or the like, to thereby control actuation sections such as a drive motor of each of the mechanisms, a vacuum pump 12, an air compressor 13, a cylinder and the like, resulting in the operation of the whole automatic tape cassette vending machine being continuously or intermittently carried out while carrying out digital display on an audio monitor 10 and/or a visual monitor 11 such as a CRT.

Also, the automatic tape cassette vending machine may include an automatic label feed mechanism 15 connected to the computer unit 7 and controlled depending upon the data on the desired conditions input thereto. The automatic label feed mechanism 15 may be constituted by, for example, a system including labels rolled up, a roller for dispensing the labels and a cutter for the dispensed label. Also, the automatic tape cassette vending machine may include a printing mechanism 16 comprising a printer for printing necessary items such as various kinds of numbers, a date at which the vending machine is used, details of recording, quality, names and the like on the label. Further, the machine may be provided with various casing magazines 17 and $17_1$ for housing the above-described casings therein and a casing discharging mechanism 18 for selectively discharging a desired casing from the casing magazines 17 and $17_1$. In addition, the machine may be provided with an automatic index card feed mechanism 19 for automatically feeding an index card to be inserted in the so-discharged casing and a card printing mechanism 20 for carrying out desired printing on the index card.

Between a tape take-up structure comprising the tape length measuring mechanism 51, splicing mechanism 52 and take-up roller 26 and the computer unit 7 is arranged a safe device such as a mechanism 50 for maintaining the machine operative when service interruption occurs, or the like. In order to keep the quality of the magnetic tapes satisfactory, there may be arranged a temperature adjusting mechanism 53 such as a mechanism for controlling a temperature in the machine and a mechanism for controlling a temperature of the splicer which may be constructed so as to control a temperature of a tape to be spliced. Also, in view of the purchase of only a casing, excessive casings may be stored in the cabinet 102. Alternatively, an additional cabinet may be arranged separate from the cabinet 102. The cabinet 102 may be a stand-type. Also, it may be a drip proof type or an open-air type installed indoors. Further, when the input operation is carried out by means of a keyboard, a dialog system taking place between an audio and visual output and an input to the keyboard may be conveniently employed.

The cabinet 102, as described above, is provided on the outer surface thereof with the specification indicator panel 114 for directing the preparation of specifications, the sample showcase 104 in which trade samples to which labels are attached are shown, the notice board 108 and the like.

The splicing mechanism 52 for the magnetic tape 24 may preferably include holding members 22 for holding the magnetic tape 24 through the sagging mechanism 40 for keeping the magnetic tape under suitable tension which is adapted to guide the magnetic tape 24 to the cassette casing 21 on which the leader tape 23 is wound up and the tape length measuring mechanism 51, as shown in FIG. 2. The splicing mechanism 52 may be arranged opposite to the cassette casing holder 41 provided with a spring clip and the like and is provided with a cutting mechanism 25 and cores 29 and 32 for the adhesive tape 33.

Figure 3:
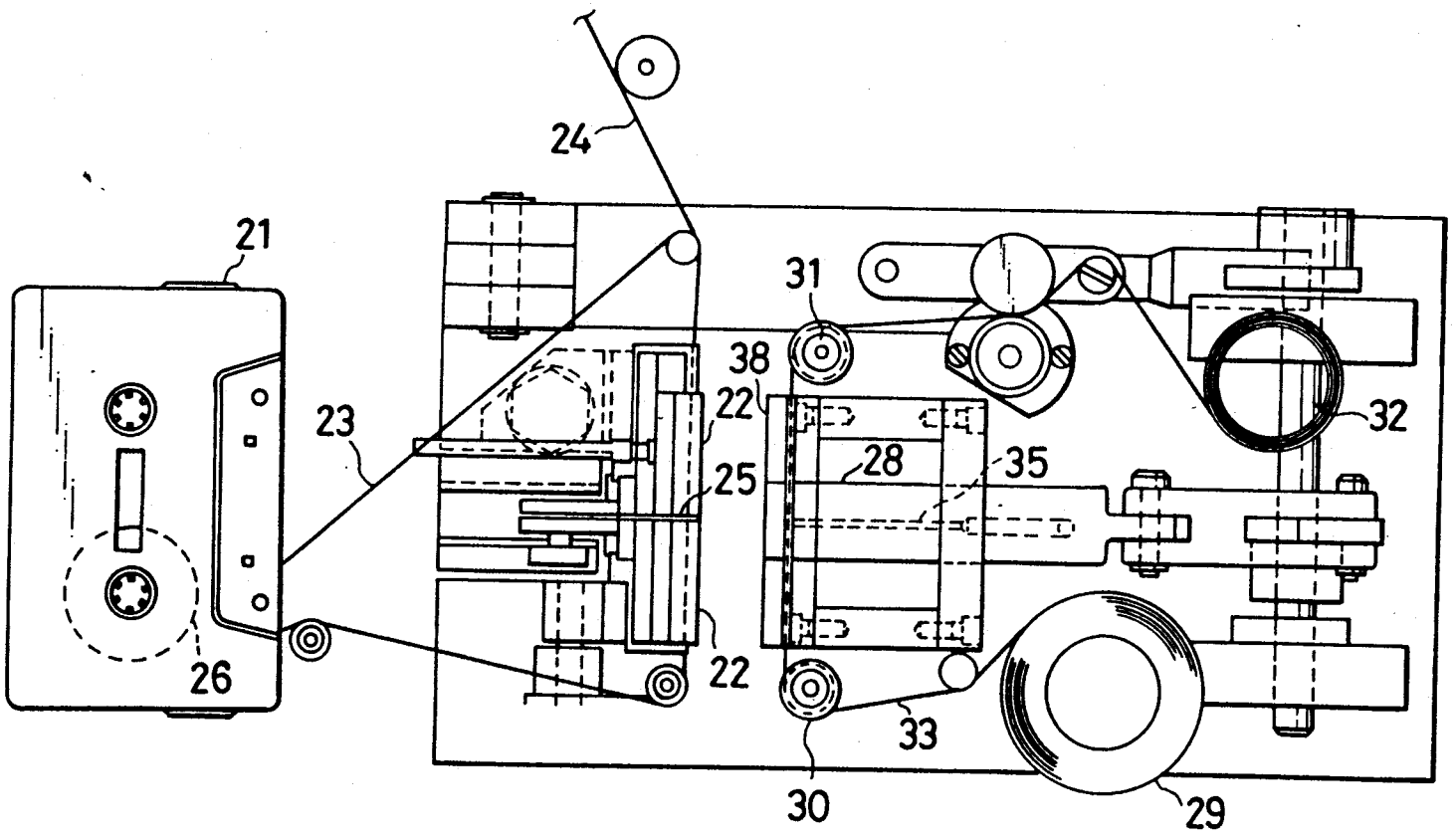
FIG. 3 is a plan view showing a splicing mechanism.
Figure 4:
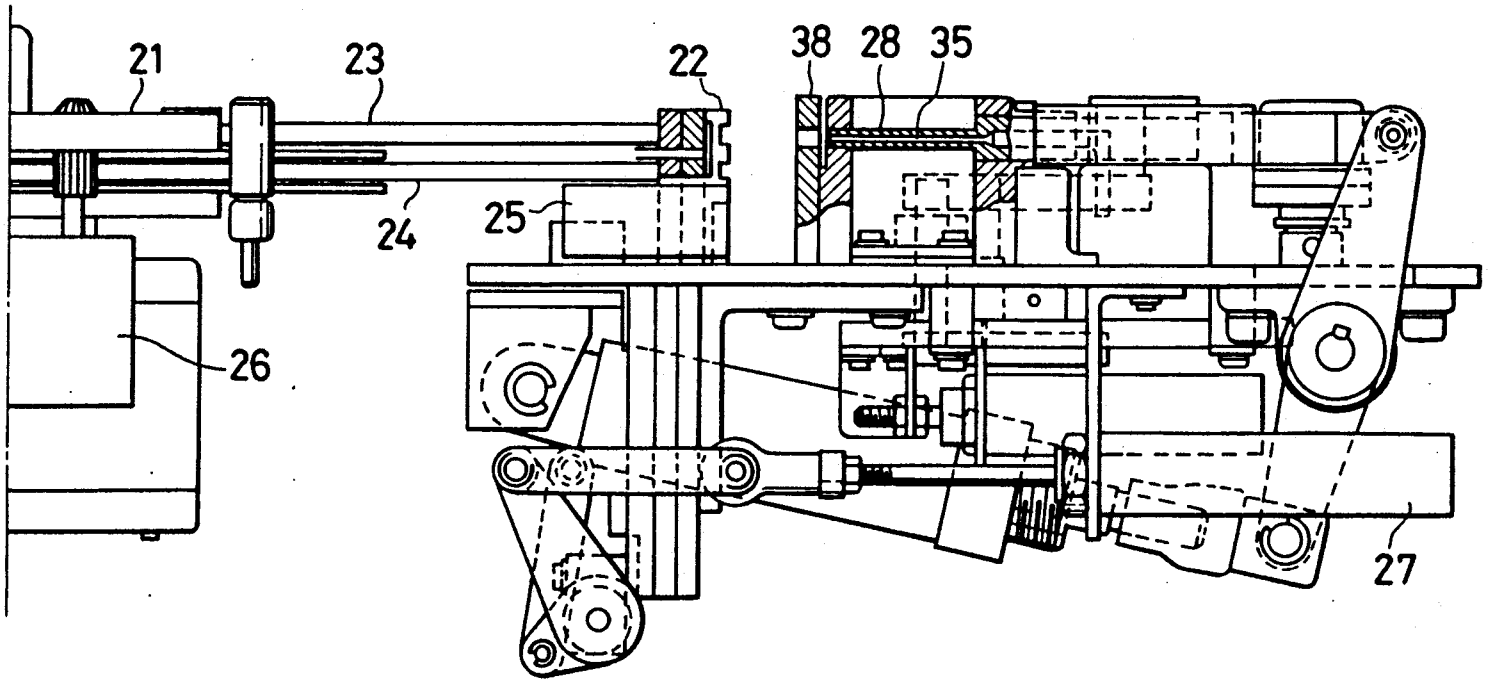
FIG. 4 is a partially cutaway side elevation view of the splicing mechanism shown in FIG. 3.

The splicing mechanism 52, as shown in, for example, FIGS. 3 and 4, may comprise the holding members 22 acting as a splicing means for sucking the magnetic tape 24 and the leader tape 23 of the cassette casing 21, the cutting mechanism 25 for cutting the magnetic tape 24 and leader tape 23 thus held on the holding members 22, the adhering mechanism for adhesively connecting the ends of the so-cut magnetic tape 24 and leader tape 23 to each other by means of an adhesive tape, and the take-up mechanism such as the take-up motor 26 for moving the magnetic tape by a predetermined length to wind up it. The so-constructed splicing mechanism is connected to the computer unit 7, resulting in being controlled.

As in an apparatus disclosed in Japanese Patent Publication No. 21784/1976, the magnetic tape 24 drawn from the feed reel is guided to the holding members 22 comprising a pair of suction plates, resulting in being sucked thereon. Then, the magnetic tape and leader tape are cut on the same line by means of the cutting mechanism 25 moved through a slit by an air actuator 27, resulting in the leader tape 23 being divided into two. The cut tip end of the magnetic tape is discarded. After the leader tape 23 and magnetic tape 24 are cut by the cutting mechanism 25, the leader tape 23 suckedly held on one suction plate upward moved is caused to face to the magnetic tape 24 at the holding members 22 and then a pressing member 28 is actuated to carry out splicing between the magnetic tape 24 and the leader tape 23 by means of the adhesive tape.

The adhesive tape 33 is so arranged at the splicing mechanism 52 that it may be drawn from the core 29 and wound up on the core 32 through guide rollers 30 and 31. The splicing mechanism 52 is constructed so as to rotate by a predetermined angle in one direction to cause the magnetic tape 24 to travel in a predetermined amount in one direction, resulting in sticking the adhesive tape 33 on the magnetic tape and leader tape along the side edges thereof without projecting therefrom. Thus, the splicing operation may be automatically accomplished.

The pressing member 28 is formed on the distal end surface thereof with a plurality of air suction holes 35. Evacuation through the air suction holes 35 of the pressing member 28 causes the portion of the adhesive tape 33 punched to advance with an abutment section 38 while being sucked on the distal end surface of the pressing member 28, to thereby help the splicing between the leader tape 23 held on the suction plate and the magnetic tape 24.

The foregoing description of the splicing mechanism 52 has been made in connection with an assembled empty cassette comprising a cassette casing provided therein with two hubs and a single leader tape wound up in the cassette casing. More particularly, when a raw tape is to be wound up in the cassette casing 21, the tape leader 23 is drawn from the cassette casing 21 and then cut into two separate leader tape pieces. Then, the magnetic tape to be wound up in the cassette casing is attached to one of the leader tape pieces and thereafter the hub to which the one leader tape piece is connected is rotated to wind up the magnetic tape of a predetermined length thereon. Subsequently, the magnetic tape is cut and the magnetic tape of the predetermined length is adhered at the rear end thereof to the other leader tape piece on the hub.

Alternatively, two hubs each connected thereto a leader tape of a small length may be used, wherein the magnetic tape is connected to the leader tape on one of the hubs, resulting in being wound up in a predetermined amount or length on the one hub. Then, the magnetic tape is connected at the rear end thereof to the leader tape on the other hub. Thereafter, the two hubs are arranged in the cassette casing. In this instance, a hub feed mechanism (not shown) and a cassette half assembling mechanism (not shown) may be provided.

Figure 1:
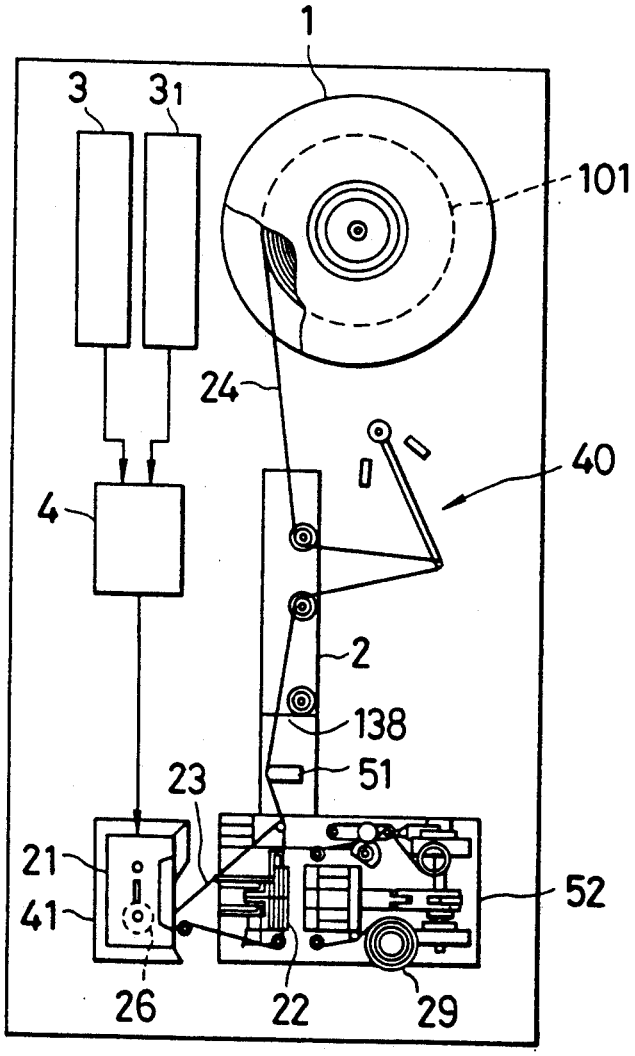
FIG. 1 is a plan view showing a mechanism for carrying out the winding of a tape into a cassette casing.

When the automatic tape cassette vending machine is to handle different kinds of magnetic tapes, the tape changing-over mechanism 2 provided with the multiple slider may be formed using the holding members 22 of the splicing mechanism 52. Such construction effectively prevents any different kind of magnetic tape of a small length from being included in the leader tape 23 of the cassette casing 21, as encountered with the system shown in FIG. 5A wherein the multiple slider 136 is arranged at the parting line 138 (FIG. 1).

Figures 7A, 7B, 7C, 7D, 7E, 7F, 7G, 7H, 7I, 7J:
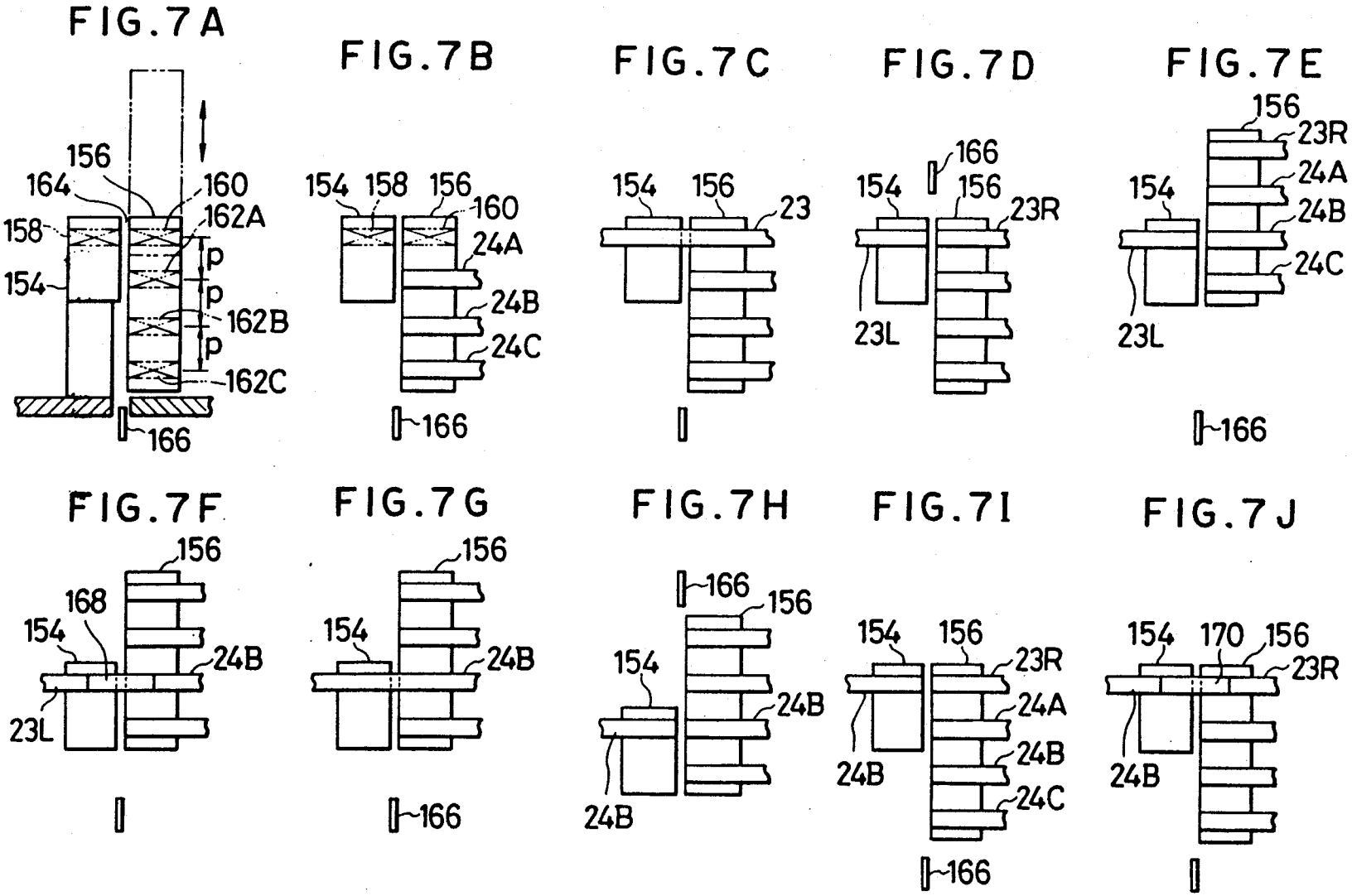
FIG. 7A is a partially sectional schematic view showing a modification of the tape changing-over mechanism shown in FIG. 5A.
FIGS. 7B to 7J each are a schematic view showing the operation of the tape changing-over mechanism shown in FIG. 7A.

More particularly, in FIG. 7A, reference numeral 154 designates a stationary holding member having substantially the same construction and function as the holding member 22 positioned on the downstream side in the direction of traveling of the magnetic tape in FIG. 3 (or on the lower side in FIG. 3). Reference numeral 156 designates a multiple slider substituted for the holding member 22 arranged on the upstream side in the direction of traveling of the magnetic tape in FIG. 3 (or the upper side in FIG. 3).

Reference numerals 158 and 160 each designate a suction section for the leader tape 23; and reference characters 162A, 162B and 162C designate suction sections for the magnetic tapes 24A, 24B and 24C, respectively. The multiple slider 156 is spaced from the holding member 154 through a gap 164 and vertically moved by one pitch p at a time by means of an intermittent lifting mechanism which may be constructed in a manner known in the art. Reference numeral 166 designates a cutter. The intermittent lifting operation is preferably carried out in such a manner that the mechanisms from the multiple slider 156 to the feed reel 101 which include the tape feed reels, the sagging mechanism 40, the tape length measuring mechanism 51, a pulley and the like provided for each of the tapes 24A, 24B and 24C are concurrently actuated integral with one another or in association with one another.

Now, the operation of selecting the magnetic tape 24B and winding up it in the cassette casing 21 will be described hereinafter with reference to FIGS. 7B to 7J.

As shown in FIG. 7B, the suction sections 158 and 160 are positioned so that their heights are aligned with each other as shown in FIG. 7B and then a loop-like leader tape 23 in the cassette casing 21 is held on the suction sections 158 and 160 as shown in FIG. 7C. Then, as shown in FIG. 7D, the leader tape 23 is cut into two leader tape pieces 23L and 23R. Subsequently, the multiple slider 156 is upward moved to cause the leader tape piece 23L to be opposite to the magnetic tape 24B to be wound up, as shown in FIG. 7E. Then, an adhesive tape 154 is connected to the magnetic tape 24B as shown in FIG. 7F and then the leader tape piece 23L is wound up in the cassette casing, resulting in the magnetic tape 24B being wound up therein. When the tape length measuring mechanism 51 detects that the magnetic tape 24B is wound up by a predetermined length, a signal generated from the mechanism 51 causes the winding-up of the tape 24B to be stopped, resulting in such a state shown in FIG. 7G. Then, the cutter cuts the magnetic tape 24B as shown in FIG. 7H. Subsequently, the multiple slider 156 is lowered to cause the tape 24B to be opposite to the leader tape piece 23R on the holding member 154 as shown in FIG. 7I. Thereafter, the leader tape piece 23R is connected to the magnetic tape 24B by means of an adhesive tape 170 as shown in FIG. 7J. Then, the connected portion is released from the holding member 154 and multiple slider 156 and then the magnetic tape 24B is wound up in the cassette casing 21, so that a tape cassette in which the magnetic tape of a desired length is wound up may be obtained.

INDUSTRIAL APPLICABILITY

The automatic tape cassette vending machine of the present invention can be widely accommodated to various requests of users, because it can readily forms a tape cassette in which a magnetic tape of a desired length is wound up by inputting desired conditions thereto through a user.

We claim:

1. An automatic tape cassette vending machine, comprising:

a plurality of tape feed reels, each storing a different type of magnetic tape;

a tape feed mechanism for dispensing magnetic tape from each of said tape feed reels, including a slider mechanism having first and second holder members, the first holder member mounting a leader tape and the second holder member mounting respective magnetic tape from each of said tape feed reels;

means for moving one of the first and second holder members relative to the other to align the leader tape with a predetermined magnetic tape;

a tape length measuring mechanism for measuring the length of the magnetic tape fed by means of said tape feed mechanism;

a magazine means for storing therein a plurality of assembled empty cassette casings, each for winding up therein the tape of which the length has been measured;

a cassette casing feed mechanism for taking out an empty cassette casing from said magazine means;

a splicing mechanism for connecting the tape which has passed through said tape length measuring mechanism to the empty cassette casing fed by said cassette casing feed mechanism;

a tape take-up mechanism for winding up the tape in the empty cassette casing;

operator means for selecting a specific magnetic tape and length of tape;

computer means for actuating said tape feed mechanism, moving means, cassette casing feed mechanism, splicing mechanism, and tape take-up mechanism, depending upon data input, and a measurement signal supplied from said tape length measuring mechanism, and means for detecting cash and/or money equivalents inserted thereinto to enable said operator means to actuate said computer unit.

2. An automatic tape cassette vending machine as defined in claim 1, wherein said splicing mechanism includes two holding members for holding the magnetic tape and leader tape thereon by suction which are arranged in a manner to be movable relative to each other in a direction perpendicular to the direction of traveling of the tape, a cutting mechanism for cutting the so-held magnetic tape and leader tape, and a connecting mechanism for connecting the cut magnetic tape and leader tape to each other;

said two holding members being movable relative to each other to select a combination of connection between the magnetic tape and the leader tape.

3. An automatic tape cassette vending machine as defined in claim 1, further comprising an automatic label feed mechanism operatively connected to said computer means for providing a label and a printing mechanism for carrying out printing on a label fed from said label feed mechanism.

4. An automatic tape cassette vending machine as defined in of claim 1 including, a mechanism for selectively discharging any desired casing from said casing magazine, an index card feed mechanism for feeding an index card inserted in the casing for the tape cassette, and a printing mechanism for carrying out printing on the index card.

5. An automatic tape cassette vending machine as defined in claim 1 including TV monitor mechanism and acoustic monitor mechanism connected to said computer means.

* * * * *